US007905740B2

(12) United States Patent
Chazottes et al.

(10) Patent No.: US 7,905,740 B2
(45) Date of Patent: Mar. 15, 2011

(54) TIGHT ASSEMBLY FOR ELECTRICAL CONNECTOR

(75) Inventors: Frédéric Chazottes, Houx (FR); Christian Campfort, Fresnay le Gilmert (FR); Michel Aeschbacher, Saint-prest (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 12/309,171

(22) PCT Filed: Jul. 13, 2006

(86) PCT No.: PCT/IB2006/003461
§ 371 (c)(1),
(2), (4) Date: Jul. 9, 2009

(87) PCT Pub. No.: WO2008/010019
PCT Pub. Date: Jan. 24, 2008

(65) Prior Publication Data

US 2009/0305539 A1 Dec. 10, 2009

(51) Int. Cl.
*H01R 13/52* (2006.01)

(52) U.S. Cl. ..... 439/271; 439/587

(58) Field of Classification Search ..... 439/271, 439/274, 275, 587, 589
See application file for complete search history.

(56) References Cited

U.S. PATENT DOCUMENTS

| | | | | | |
|---|---|---|---|---|---|
| 4,580,863 | A * | 4/1986 | Lohr et al. | ..... | 439/695 |
| 4,588,242 | A * | 5/1986 | McDowell et al. | ..... | 439/589 |
| 4,648,672 | A * | 3/1987 | Kobler | ..... | 439/271 |
| 5,145,410 | A * | 9/1992 | Maejima et al. | ..... | 439/587 |
| 5,538,441 | A * | 7/1996 | Paolucci et al. | ..... | 439/589 |
| 6,102,740 | A * | 8/2000 | Murakami et al. | ..... | 439/598 |
| 7,033,216 | B2 * | 4/2006 | Ito | ..... | 439/587 |
| 7,338,319 | B2 * | 3/2008 | Casses et al. | ..... | 439/587 |
| 7,637,764 | B2 * | 12/2009 | Yoneda et al. | ..... | 439/275 |

FOREIGN PATENT DOCUMENTS

| | | | |
|---|---|---|---|
| EP | 0 625 807 | A2 | 11/1994 |
| EP | 1 536 527 | A1 | 6/2005 |
| WO | WO-2004/025787 | A1 | 3/2004 |

* cited by examiner

*Primary Examiner* — Thanh-Tam T Le
(74) *Attorney, Agent, or Firm* — Harrington & Smith

(57) ABSTRACT

The invention proposes an assembly for an electrical connector including: —a resilient sealing mat seal having two main surfaces and a plurality of channels extending between said two main surfaces, each channel being intended to receive a respective electrical wire, and wherein a annular sealing lip is provided within each channel and extends from the channel wall towards a center axis of said channel; and —at least one sealing sleeve entirely surrounding a portion of an electrical wire to be introduced in one of said channels and tightly maintained on said wire; wherein the sealing sleeve has at least a portion with a smooth outer surface and an outer cross-section of said portion chosen such that said portion of the sealing sleeve and the channel lip are in tight engagement with each other when the wire provided with said sealing sleeve is positioned in its respective channel.

7 Claims, 2 Drawing Sheets

TIGHT ASSEMBLY FOR ELECTRICAL CONNECTOR

FIELD OF THE INVENTION

The invention relates to an assembly for an electrical connector comprising:

a resilient mat seal having two main surfaces and a plurality of channels extending between said two main surfaces, each channel intended to receive a respective electrical wire, and wherein an annular lip is provided within each channel and extends from the channel wall towards a center axis of said channel; and at least one sealing sleeve surrounding a portion of an electrical wire to be introduced in one of said channels and tightly maintained on said wire.

The invention also relates to an electrical connector comprising this tight assembly.

More particularly, the invention relates to a multiway electrical connector, like a male or a female multiway connector.

This kind of connectors may be used for connecting electrical elements of a motor vehicle to other electrical elements.

TECHNICAL BACKGROUND

Multiway electrical connectors are well known. These connectors are made of a rigid material and includes a plurality of cavities in a back end for receiving a plurality of electrical wires ended by crimped terminal fittings. At their front ends, these connectors are provided with female or male connecting elements for receiving a complementary counterpart connector. Between these two ends, channels extend between corresponding cavities, for receiving the said electrical wires.

Usually, a one-piece or integral resilient mat seal is sandwiched between a front part and a rear part of the connector. The mat seal has a plurality of channels such that, when the mat seal is mounted in the connector, each channel of the mat seal faces an associated channel of the connector.

During the insertion of the electrical wires in the channels of the rear part of the connector, the channels of the mat seal are passed by the plurality of terminal fittings that are then housed in the channels of the front part of the connector. The said terminal fittings are then at the neighboring of the front end of the connector.

The channels of the mat seal are further arranged for tightly maintained the electrical wires.

This resilient mat seal is thus preventing moisture and dust by entering the connector.

It is known by example from EP 0 625 807 to obtain a good tight contact between the electrical wires and the mat seal, by providing the surfaces of the channels with lips extending inwardly. These lips allow the passage of the terminal fittings and then press the electrical wires, when the terminal fittings are passed. The tightness is then ensured.

A problem raised by this kind of mat seal is that, if the cross-section of the wires is not substantially the same as those of the terminal fittings, the passage of the terminal fittings stress the said lips. The latter cannot then press efficiently the wire for ensuring a sufficient tightness.

Additionally, there is a need for mat seals adapted for receiving wires having different cross-sections.

US 2005/0118850 attempts to solve these problems by firstly proposing a mat seal having the following two different types of channels:

channels having lips extending inwardly from their surface;

channels having smooth surface.

Channels of the first type are designed for receiving wires having small cross-sections. The principle is the same as those disclosed in EP 0 625 807.

Channels of the second type are designed for receiving wires having large cross-sections.

In this second type, a portion of the outer surface of the wires is surrounded with a resilient sealing sleeve. This sealing sleeve has lips extending outwardly from its outer surface. The mat seal has further a cross-section equal or greater than the terminal fittings.

The passage of the terminal fittings is then not aggressive to the smooth surface of the mat seal channels, the tightness being then ensured by the pressure of the lips of the sealing sleeve to the smooth surface of the corresponding channels.

Additionally, this tight assembly can provide a tight contact for two wires having different cross-sections.

But the problem stays the same for the wires with small cross-sections.

Additionally, it would be grateful to provide a mat seal having channels designed so that each one can receive wires with different cross-sections.

WO 2004/025787 proposes a tight assembly wherein wires having different cross-sections can be tightly secured in one channel of a mat seal.

This channel has the two following portions:

a front portion with a smooth surface;

a rear portion provided with lips extending inwardly from the smooth surface.

Wires having large cross-sections are tightly secured at the channel rear portion.

Wires having small cross-sections are provided, on a portion of their outer surface, with sealing sleeve having lips extending outwardly from its outer surface. These wires are then tightly secured at the channel front portion by the lips of the sealing sleeve which are tightly secured at the smooth channel rear portion.

An objective of the invention is to propose a low-cost and easier tight assembly to manufacture, which overcomes the foregoing problems.

A particular objective of the invention is to propose a tight assembly that can ensure the tightness of an electrical connector, that can be used for different cross-sections of electrical wires to connect.

For this purpose, this invention proposes a assembly for an electrical connector comprising:

a resilient mat seal having two main surfaces and a plurality of channels extending between said two main surfaces, each being intended to receive a respective electrical wire, and wherein an annular sealing lip is provided within each channel and extends from the channel wall towards a center axis of said channel; and at least one sealing sleeve entirely surrounding a portion of an electrical wire to be introduced in one of said channels and tightly maintained on said wire;

wherein the sealing sleeve has at least a portion with a smooth outer surface and an outer cross-section of said portion chosen such that said portion of the sealing sleeve and the channel lip are in tight engagement with each other when the wire provided with said sealing sleeve is positioned in its respective channel.

Other characteristics of this tight assembly are:

it further comprises at least one electrical wire and one terminal fitting fixed to each electrical wire, wherein the said sealing sleeve surrounded the portion of the electrical wire neighboring the terminal fitting;

it further comprises at least one electrical wire which is not surrounded by the said sealing sleeve, wherein the cross-section of this electrical wire is substantially the same as the cross-section of the said sealing sleeve;

the sealing sleeve is partly hold by the terminal fitting;

the mat seal is integrally molded.

According to a second aspect, the invention proposes an electrical connector intended to be connected to a counterpart electrical connector along a plugging axis, comprising:

a plastic housing provided with a plurality of channels extending parallel to the plugging axis, the plastic housing having a front part and a rear part mounted together, the front part having a front face provided with metallic pins or crossing holes for respectively receiving holes or pins of the counterpart electrical connector;

a resilient mat seal between the front part and the rear part of the plastic housing, the resilient mat seal having two main surfaces and a plurality of channels extending between said two main surfaces and corresponding to the channels of the plastic housing, and wherein an annular sealing lip is provided within each channel and extends from the channel wall towards a center axis of said channel;

electrical wires engaged in said channels of the plastic housing and in said channels of the mat seal;

at least one sealing sleeve entirely surrounding a portion of at least one electrical wire engaged in one of said channels and tightly maintained on said wire, wherein the sealing sleeve has at least a portion with a smooth outer surface and an outer cross-section of said portion chosen such that said portion of the sealing sleeve and the channel lip are in tight engagement with each other when the wire provided with said sealing sleeve is positioned in its respective channel.

Another characteristic of this electrical connector is:

the electrical wires are fixed to metallic terminal fittings.

Other means, objectives and advantages of the invention will appear clearly in support of the following specification, not limitative, illustrated by the following figures.

DETAILED DESCRIPTION OF THE INVENTION

Figure 1:
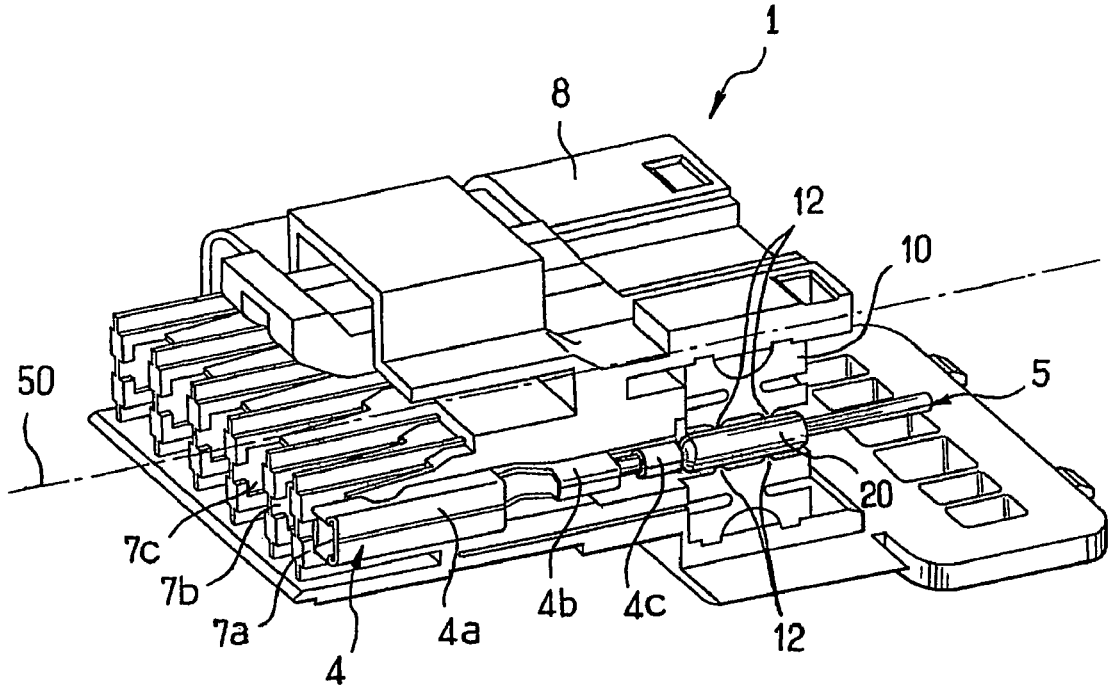
FIG. 1 shows a side cross-section of a multiway electrical connectors according to the invention, in the case of the electrical wire is of a small cross-section.

According to FIG. 1, a cross-section from a lateral side of a multiway electrical connector provided with a tight assembly according to the invention is shown. The electrical connector 1 comprises a body in plastic material 8 having a front part and a rear part mounted one to the other and separated to each other by a mat seal 10 according to the invention. The plastic body 8 is provided with a plurality of channels extending parallel to the plugging axis 50. Especially, the rear part of the body 8 (shown in FIGS. 1 and 2) comprises several housings or cavities 7*a*, 7*b*, 7*c* . . . (that are parts of the said channels) extending parallel to the plugging axis 50 for receiving each a terminal fitting 4 crimped with an electrical wire 5 engaged in the said channels. On this FIG. 1, the terminal fitting 4 is a female fitting connector comprising:

a front part 4*a* arranged for cooperating with a complementary male terminal fitting connector, a rear part 4*c* surrounding the insulating ended part of the electrical wire 5 and receiving the wire 5, and an intermediate part 4*b* crimped with the stripped ended part of the electrical wire 5.

Each cavity 7*a*, 7*b*, 7*c* . . . can receive a female terminal fitting 4, as previously described, or a male terminal fitting.

A terminal fitting 4 may be crimped around an electrical wire that can have a small cross-section, i.e. a cross-section inferior to the cross-section of the terminal fitting.

A terminal fitting may also be crimped around an electrical wire having substantially the same cross-section as the cross-section of the terminal fitting.

According to the invention, the tight assembly of the connector 1 comprises, on one hand, a resilient multiway mat seal 10, mounted in the connector 1, and, on the other hand, one or several one-piece sealing sleeves 20 fixed to electrical wires 5.

The multiway resilient mat seal 10 comprises one or several channels 11, each aimed to receive an electrical wire 5. More precisely, the multiway resilient mat seal 10 comprises a channel 11 extending from the end of each cavity 7*a*, 7*b*, 7*c* . . . of the connector 1. Thus, each channel 11 receives an electrical wire 5 which ends in the terminal fitting housed in the cavity located at the extension of the considered channel 11.

If the electrical wire 5 is of a small cross-section, the one-piece sealing sleeve 20, for example tubular-shaped, surrounds the electrical wire 5, on a portion of its length. The one-piece sealing sleeve 20 is smooth i.e. without lip or the like. It can be made from a soft material.

It is introduced in the channel 11 of the mat seal 10. Of course, the tight assembly according to the invention comprises a number of one-piece sealing sleeves that are quite the same as the number of electrical wires that have a small cross-section.

It is to be understood that the one-piece sealing sleeve 20 surrounds the wire 5 at the zone where the electrical connection is not crimped.

The one-piece sealing sleeve 20 has a smooth outer surface. Especially, the one-piece sealing sleeve 20 has no lip.

The sealing sleeve 20 is then easy to manufacture.

Each channel 11 of the multiway mat seal 10 has a generally cylindrical shape from the surface of which at least one lip 12 is extended inwardly, this at least one lip 12 is designed for pressing the sealing sleeve 20 (and thus the electrical wire 5) in order to prevent the penetration of moisture or dust in the connector.

Figure 2:
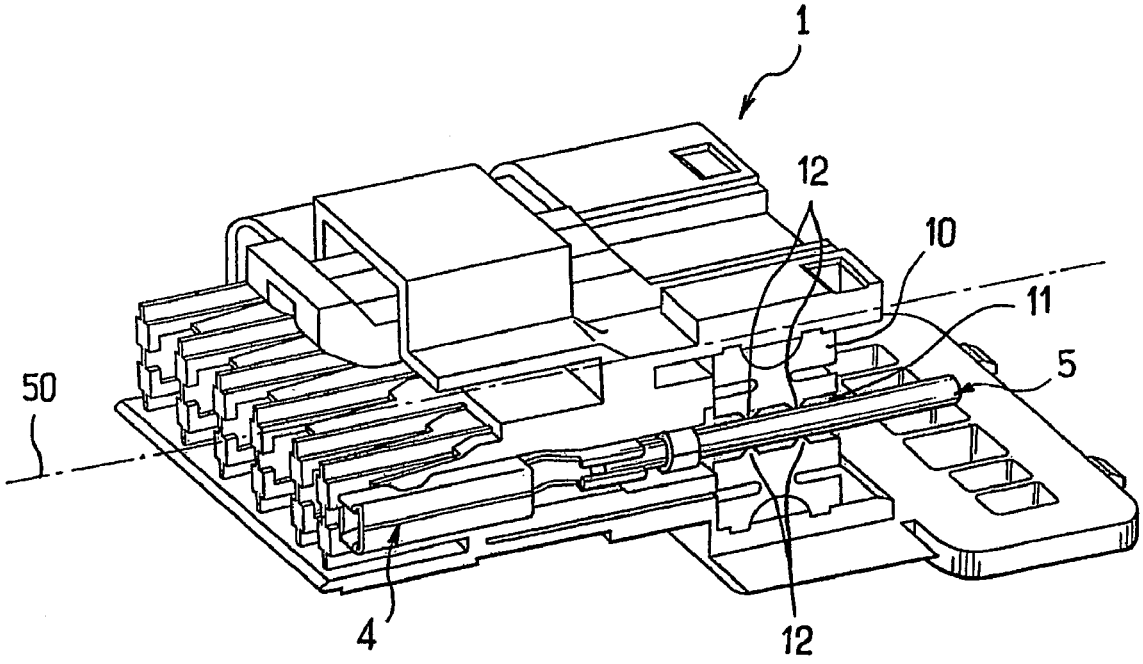
FIG. 2 shows a side cross-section of a multiway electrical connectors according to the invention, in the case of the electrical wire has a cross-section of the same dimension as the cross-section of the terminal fitting.

With reference to FIG. 2, the same electrical connector as those of FIG. 1, but with an electrical wire 5 having a cross-section equal or greater than the cross-section of the terminal fitting 4, is shown. For example, in the case of FIG. 1, the electrical wire 5 has a cross-section inferior to 1 $mm^2$ while in the case of FIG. 2, it has a cross-section greater than 1 $mm^2$.

In that case, as the cross-section of the electrical wire 5 is substantially the same as or greater than the cross-section of the terminal fitting 4, the passage of the terminal fitting in the channel 11 does not risk to deteriorate the lip(s) 12, and then the quality of its pressure onto the wire 5. The lip(s) 12 ensures then by itself the tightness of the connector. It is thus not necessary in this case to use a one-piece sealing sleeve 20.

Accordingly, depending on the value of the cross-section of the electrical wire 5, the tightness of the connector 1 is ensured by the pressure of the lip(s) 12 either on the one-piece sealing sleeve 20 (FIG. 1) or directly on the electrical wire 5 (FIG. 2).

Figure 3:
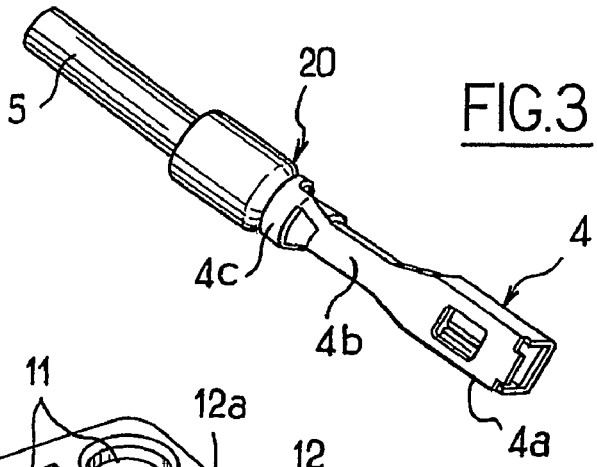
FIG. 3 shows a sealing sleeve, electrical wire and a terminal fitting fixed together according to the invention.

FIG. 3 shows the one-piece sealing sleeve 20 surrounding a portion of an electrical wire 5 crimped onto a terminal fitting 4. The terminal fitting 4 is shown from a backside view.

Figure 6:
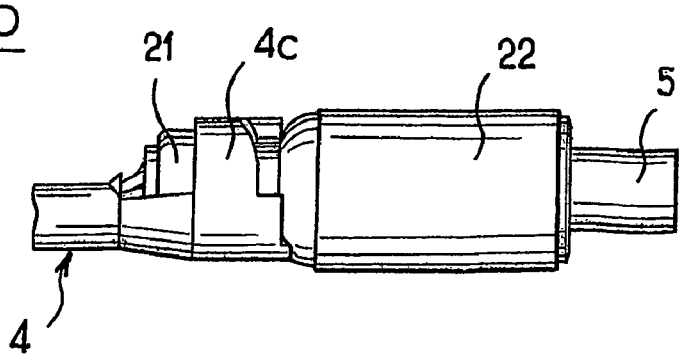
FIG. 6 shows a side view of the connection part of a sealing sleeve with a terminal fitting with an electrical wire.

As shown in FIG. 6, the rear part 4*c* of the terminal fitting 4 serves as receiver of the one-piece sealing sleeve 20.

Figure 5:
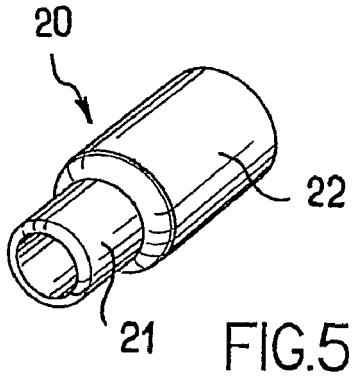
FIG. 5 shows a perspective view of a sealing sleeve according to the invention.

As shown in FIG. 5, a front portion 21 of the sealing sleeve 20 may have an outer diameter lower than the rear portion 22 of the sealing sleeve 20, such that the terminal fitting 4 can be mounted on the front portion 21 and that the outer diameter of the terminal fitting 4 is similar or lower than the outer diameter of the rear portion 22 as shown on FIG. 6.

This FIG. 3 shows also the smooth outer surface of the one-piece sealing sleeve 20. This sealing sleeve 20 can be hold, at least partly, in the terminal fitting 4 (as shown in FIG. 6) or simply stopped to the receiver part 4*c*.

As previously suggested, such a one-piece sealing sleeve 20 has the advantage of locally increasing the cross-section of the electrical wire 5, if the latter is small in comparison to those of the terminal fitting 4.

It is to be noticed that a tightness is also ensured between the sealing sleeve 20 and the electrical wire 5 by a manner known per se by the man skilled in the art.

Figure 4:
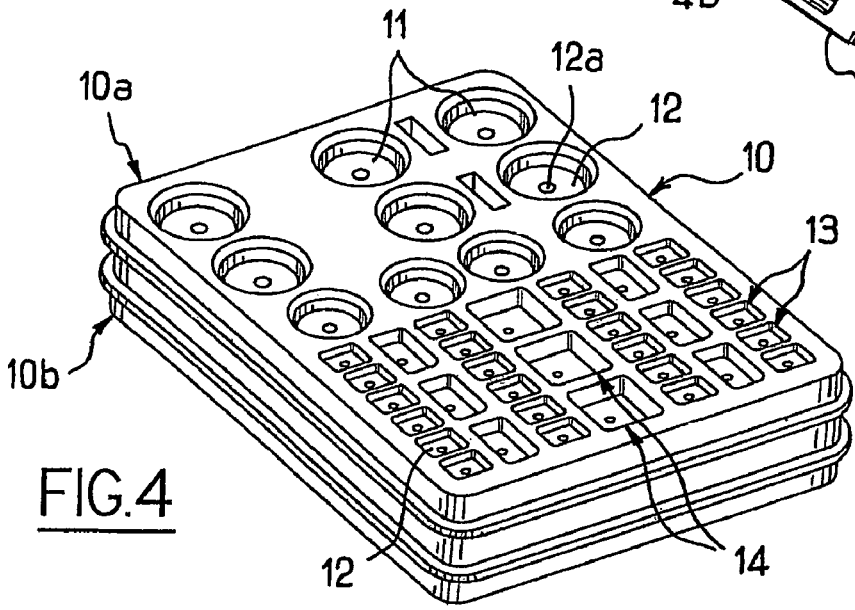
FIG. 4 shows a multiway resilient mat seal of a tight assembly according to the invention.

With reference to FIG. 4, an example of multiway mat seal 10 according to the invention is shown. This multiway mat seal 10 is manufactured in a resilient and tight material. It includes a plurality of channels that may have different shapes and dimensions. The channels may have a disk-shaped cross-section, like the channel 11 previously described, or a square-shaped cross-section, like channels 13 and 14. The shapes and dimensions of channels depend on the type of terminal fittings 4 and of the electrical wires 5.

At least one of these channels is provided with the said at least one lip 12, extending inwardly from the surface of the channel. This lip 12 is designed for leaving a free space 12*a* at its center. The cross-section of this free space 12*a* is inferior to the cross-section of the one-piece sealing sleeve 20 and of the electrical wires 5 having large cross-section.

Thus the one-piece sealing sleeve 20 (FIG. 1) or the electrical wire 5 (FIG. 2) stresses the lip 12 when engaged into the channel 11. The lip 12 is then warped and permanently presses the electrical wire 5, ensuring then the tightness of the connector 1.

The multiway mat seal 10 according to the invention can be manufactured in two plates 10*a* and 10*b* positioned one to the other such that the channels be in accordance. The two plates can be fixed together by different means of fixation like for example some glue.

Alternatively, the resilient mat seal 10 may be manufactured in one piece.

In the embodiment illustrated by FIGS. 1 and 2, it can be introduced, in the channel 11, either an electrical wire of small cross-section and provided with one-piece sealing sleeve 20, or an electrical wire having a larger cross-section, without any need of the one-piece sealing sleeve 20.

The tight assembly according to the invention permits then to connect different types of electrical wires 5 in one channel 11 of the connector 1.

Additionally, the tight assembly is easy to manufacture, as the one-piece sealing sleeve has a simple shape (like a cylindrical shape), with no need of lips or other specific elements.

The invention claimed is:

1. An assembly for an electrical connector comprising:

a resilient mat seal having two main surfaces and a plurality of channels extending between said two main surfaces, each channel being configured to receive a respective electrical wire, and wherein an annular sealing lip is provided within said channel and extends from a channel wall towards a center axis of said channel; and at least one sealing sleeve configured to entirely surround a portion of the electrical wire to be introduced in one of said channels and tightly maintained on said wire; wherein the sealing sleeve has a rear portion extending a majority of a length of the sealing sleeve which has an entire smooth outer surface and an outer cross-section of said rear portion being configured such that said rear portion of the sealing sleeve and the channel lip are in tight engagement with each other when the wire provided with said sealing sleeve is positioned in a respective one of said channels.

2. Assembly according to claim 1, further comprising at least one first electrical wire and one terminal fitting fixed to the first electrical wire, wherein said sealing sleeve surrounded the portion of the electrical wire neighboring the terminal fitting.

3. Assembly according to claim 2, further comprising at least one second electrical wire which is not surrounded by said sealing sleeve, wherein the cross-section of the second electrical wire is substantially the same as the cross-section of said sealing sleeve.

4. Assembly according to claim 3, wherein the sealing sleeve is partly held by the terminal fitting.

5. Assembly according to claim 1, wherein the mat seal is integrally molded.

6. Electrical connector intended to be connected to a counterpart electrical connector along a plugging axis, comprising:

a plastic housing provided with a plurality of channels extending parallel to the plugging axis, the plastic housing having a front part and a rear part mounted together, the front part having a front face provided with metallic pins or crossing holes for respectively receiving holes or pins of the counterpart electrical connector;

a resilient mat seal between the front part and the rear part of the plastic housing, the resilient mat seal having two main surfaces and a plurality of channels extending between said two main surfaces and corresponding to the channels of the plastic housing, and wherein an annular sealing lip is provided within each channel of the resilient mat seal and extends from a channel wall towards a center axis of said channel of the resilient mat seal;

electrical wires engaged in said channels of the plastic housing and in said channels of the mat seal;

at least one sealing sleeve entirely surrounding a portion of at least one electrical wire engaged in one of said channels of the resilient mat seal and tightly maintained on said wire, wherein the sealing sleeve has a portion extending a majority of a length of the sealing sleeve with an entirely smooth outer surface and an outer cross-section of said portion which is sized and shaped such that said portion of the sealing sleeve and the channel lip are in tight engagement with each other when the wire provided with said sealing sleeve is positioned in a respective one of said channels of the resilient mat seal.

7. Electrical connector according to claim 6, wherein the electrical wires are fixed to metallic terminal fittings.

* * * * *